US005160057A

United States Patent [19]

Fitjer

[11] Patent Number: 5,160,057

[45] Date of Patent: Nov. 3, 1992

[54] CONTAINER FOR COSMETICS, IN PARTICULAR MASCARA UNIT

[75] Inventor: Holger Fitjer, Ansbach, Fed. Rep. of Germany

[73] Assignee: Georg Karl Geka-Brush GmbH, Bechhofen-Waizendorf, Fed. Rep. of Germany

[21] Appl. No.: 627,131

[22] Filed: Dec. 13, 1990

[30] Foreign Application Priority Data

Dec. 20, 1989 [DE] Fed. Rep. of Germany ..... 3942000

[51] Int. Cl.[5] ..... A45D 34/00; B65D 41/04

[52] U.S. Cl. ..... 215/1 C; 215/216; 215/331

[58] Field of Search ..... 215/31, 1 C, 227, 330, 215/331, 217; 206/15.2

[56] References Cited

U.S. PATENT DOCUMENTS

| | | | |
|---|---|---|---|
| 3,858,740 | 1/1975 | Lestaevel | 215/331 X |
| 3,984,021 | 10/1976 | Uhlig | 215/217 X |
| 4,335,823 | 6/1982 | Montgomery et al. | 215/216 X |
| 4,597,501 | 7/1986 | Gueret | 215/330 |
| 4,632,240 | 12/1986 | Goncalves | 206/15.2 |
| 4,646,949 | 3/1987 | Stull | 215/330 X |
| 4,662,530 | 5/1987 | Goncalves et al. | 215/331 X |
| 4,667,836 | 5/1987 | McLaren | 215/216 |
| 4,691,833 | 9/1987 | Ahrens | 215/331 X |
| 4,832,220 | 5/1989 | Quennessen | 215/331 |
| 4,858,777 | 8/1989 | Morel | 215/331 X |

FOREIGN PATENT DOCUMENTS 8712015 12/1987 Fed. Rep. of Germany .

*Primary Examiner*—Sue A. Weaver
*Attorney, Agent, or Firm*—Browdy and Neimark

[57] ABSTRACT

Reducing wear and achieving an even more exact position, in particular with containers (1) of soft plastics, is achieved in a container (1) for cosmetics comprising at least one stop shoulder (8) and a return stop (10) for fixing a screw closure cap (14) in a defined end position. The extent (E) of the angle at circumference of the return stop (10) in relation to the position of the start of the thread and the thread pitch and the position of the stop shoulder at the container shoulder (3) are chosen in such a way that in the course of closing, the catch projection on the screw closure cap (14) contacts the top of the return stop (10) and from there arrives in the stop position in the course of essentially downward movement.

7 Claims, 3 Drawing Sheets

CONTAINER FOR COSMETICS, IN PARTICULAR MASCARA UNIT

FIELD OF THE INVENTION

The invention relates to a container for cosmetics, in particular a mascara unit, comprising a base element of plastic with a front shoulder extending approximately parallel to the container bottom and a threaded neck axially extending away from it, on which a screw closure cap can be threaded. For the purpose of obtaining a defined final position for the screw closure cap, at least one return stop in the shape of a catch projection is disposed at a distance from the stop shoulder, over a defined angular area along the container shoulder. The return stop is located on the bottom area of the threaded neck at the container shoulder. A catch recess, for a catch and stop projection, which protrudes beyond the lower edge of the screw closure cap is provided between this stop shoulder and the return stop. The catch recess in the locked stages is engaged between the stop shoulder and the return stop. The thread pitch, the start of the thread of the threaded neck and the screw closure cap are of such dimensions or are placed such that the stop and catch projection, of the screw closure cap, in the final catch position, comes to rest with its lower end at the lower end of the stop shoulder of the container shoulder.

BACKGROUND OF THE INVENTION

Some containers for cosmetics of the type described above have a rectangular or oval shape, not symmetrically circular in cross sections. It is important in creating an aesthetically appropriate appearance from the outside that the closure cap and the container be in exact alignment with each other or have a defined orientation towards each other. The same is true for containers and closure caps with circular cross sections, where printing extends over both parts such that exact positioning of the closure cap is required for the printing or the design to have their full impact. This is normally achieved using at least one stop shoulder, which definitely limits the end position and a return stop. As a rule, the return stop consists of a catch projection and a catch recess and assures that the closure cap cannot move back from its resting position against the stop shoulder. Such an arrangement exists in a variety of embodiments. For example, a container of this type is described in the German Utility Patent DE-GM 87 12 015.

This closure technology works well with containers of relatively hard plastics. However, problems arise if containers of softer plastic are used. However, use of such softer plastics is required or desirable with liquids containing a large amount of water, because of the favorable barrier effects of these plastics. It has been shown that with soft plastics the return stop as well as the stop shoulder are subject to wear. The soft plastic wears off and is deformed at the return stop or the stop shoulder after several closings, and the stops can no longer function to assure the intended defined closure position.

SUMMARY OF THE INVENTION

It is an object of the invention to provide a container of the type mentioned above, such that its useful properties remain unchanged, even with the use of soft plastics and after multiple or frequent operation of the closure system. This object is attained, in accordance with the invention, by choosing the extent of the angle at circumference of the return stop, in relation to the position of the start of the thread and the thread pitch, and the position of the stop shoulder at the container shoulder, such that in the course of closing the catch projection on the screw closure cap contacts the top of the return stop and from there descends to the stop position in an essentially downward movement. By means of this arrangement, wear on the return stop by the closure cap is prevented.

Extensive research into the cause of wear to the prior closure systems has revealed that a planing effect occurs in the course of screwing on the closure cap in conventional closure systems. As the stop shoulder on the closure cap comes closer to the container shoulder, it first reaches the area of the top of the container shoulder and then in the course of continued rotating movement is lifted to overcome the return stop which is in the form of a catch projection. This lifting occurs partially by elastic deformation of the container shoulder and partially by utilizing the thread tolerance. In the course of this lifting, the stop shoulder on the closure cap causes the return stop to be "planed off" and the exterior shape of the stop shoulder on the closure cap is also subject to heavy wear.

In contrast, the present this invention relates to the recognition that it is possible to obtain a considerably improved wear pattern if the stop shoulder of the closure cap contacts the top of the return stop and does not need to be lifted. The catch effect thus achieved is the same as with the conventional closure system, but without the excessive wear.

The present invention provides that the return stop is so placed and is of such a size that A is greater than $H/\tan \alpha$, where A is the distance between the base of the stop shoulder to the back end of the return stop, H is the height of the return stop, measured starting at the container shoulder, and $\alpha$ is the thread pitch. As a rule, the top of the return stop will be made essentially flat and extend parallel to the container shoulder. To the extent that the top is rounded, the height H is defined by the height in the contact area between the stop and the catch projection of the closure cap.

To accommodate the thread tolerances required for easy movement and possible tolerances during manufacture, it can be provided that the return stop be placed and be of such a size that $A > H/\tan(\alpha+\Delta)$, where is the thread tolerance. To obtain a particularly defined stop and to prevent rounding of the container shoulder even with frequent use, it can be furthermore provided that the stop shoulder at the container shoulder is obliquely inclined with respect to the longitudinal axis of the container while forming an undercut.

Accordingly, the stop and catch projection of a screw closure cap is provided so as to be obliquely inclined with respect to the longitudinal axis corresponding to the stop shoulder on the container shoulder in such a way that it lies flat against it in the closed end position.

To achieve a defined positioning in the end position and in the axial direction, the stop and catch projection on the screw closure cap are provided to have, looking in the peripheral direction, two sections offset with respect to each other. In the locked end position, one of the sections rests on the container shoulder in the area between the stop shoulder and the return stop, and the second section lies on the return stop.

As already mentioned, the arrangement of the invention assures high wear resistance, in particular with containers made of softer plastics. For this reason it is possible to make the container of plastics such as polypropylene, polyethylene, low pressure polyethylene, acrylonitrile-butadiene-styrene copolymers or polyethylene terephthalate.

BRIEF DESCRIPTION OF THE DRAWING

The invention will be described below in detail by means of an exemplary embodiment in connection with the drawings.

DETAILED DESCRIPTION

Figure 6:
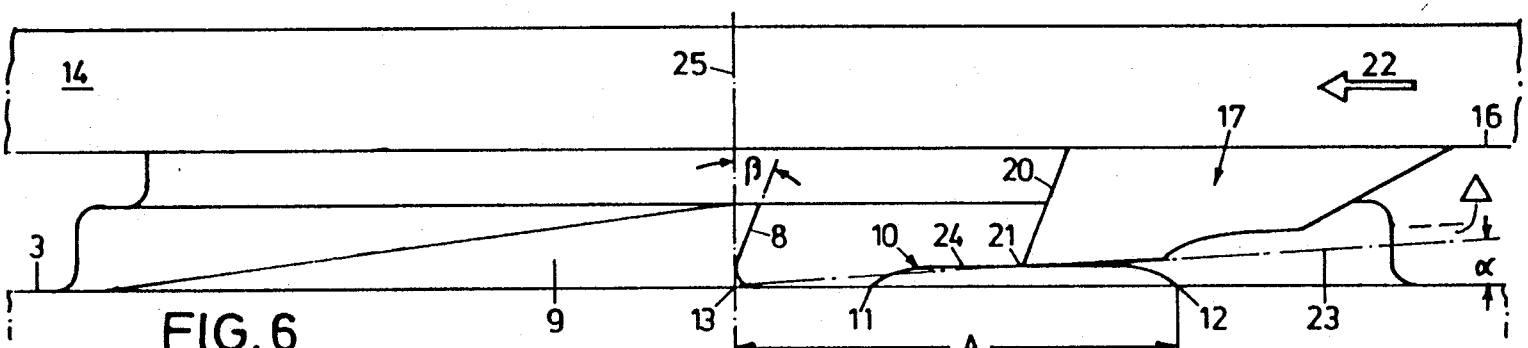

A container 1, illustrated in the drawings, comprises a base element 2 having a square, rounded-off cross-sectional shape. The base element 2 recedes inwardly at the top forming a container shoulder 3 and a threaded neck 4 with an exterior thread 5 extending axially away from the container shoulder 3. The exterior thread 5 has a thread start 6 and a thread end 7 and in the exemplary embodiment has a thread pitch of 1.75. Two stop shoulders 8, offset from each other by 180°, are provided on the container shoulder 3 and are formed on stop elements 9 extending upwardly from the container shoulder 3. As can be seen in particular from FIGS. 6 and 7, a return stop 10 is provided at a distance S from each stop shoulder 8, the return stops 10 themselves also being offset from each other by 180°. Each return stop 10, in the form of a catch projection, extends over an area E of the angle at circumference, from an end 11 facing the respectively associated stop shoulder 8 to an end 12 facing away from it. The distance from the base 13 of each stop shoulder 8 to the end 12 of the return stop 10 which faces away has been designated by A in FIG. 6.

Figure 1:
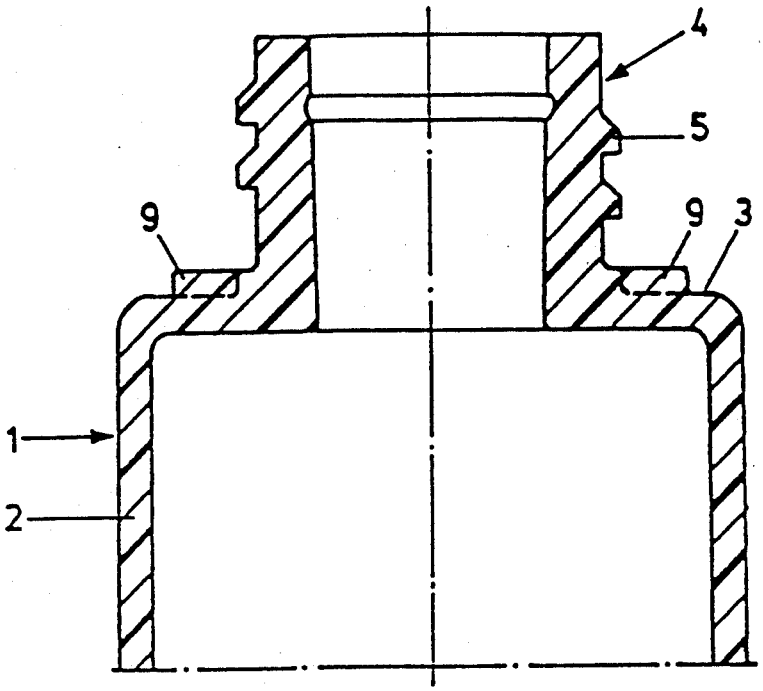
FIG. 1 is a longitudinal section through the top of a container in accordance with the invention.
Figure 2:
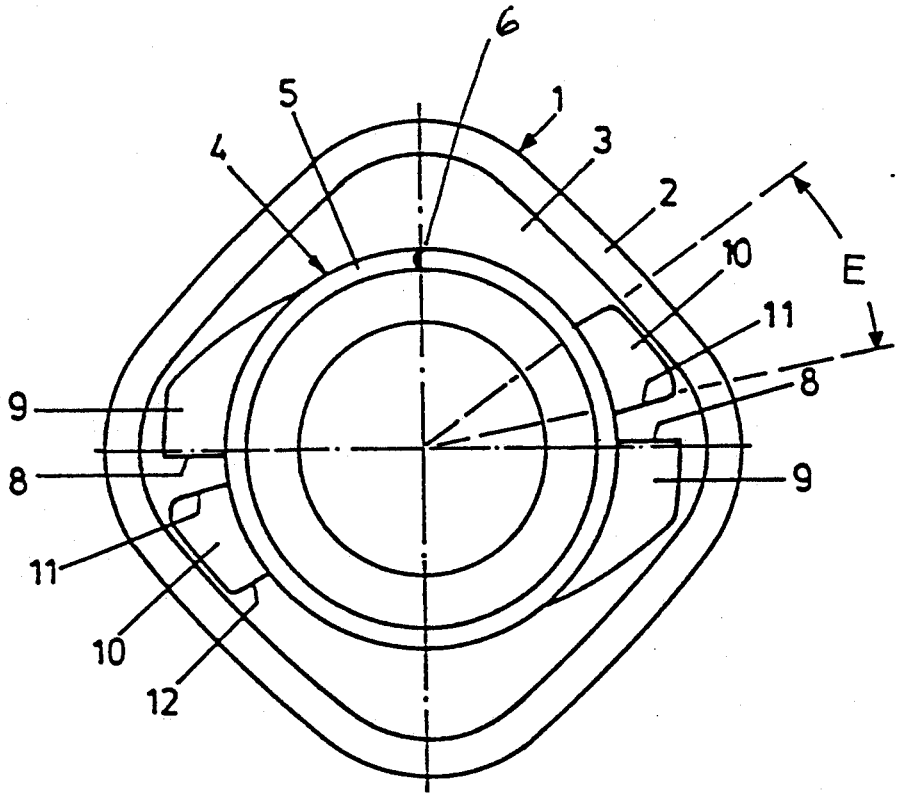
FIG. 2 is a top view of the container shown in FIG. 1.
Figure 3:
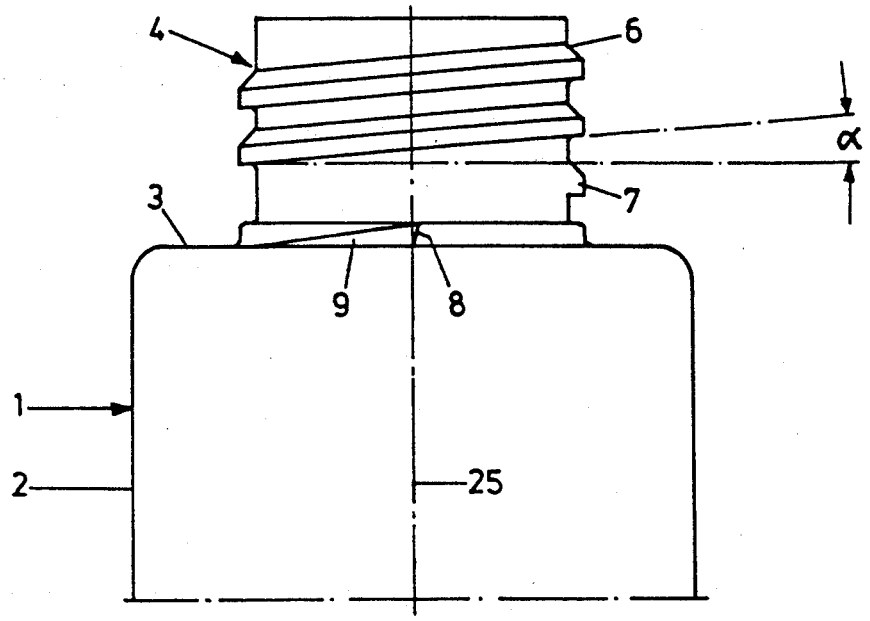
FIG. 3 is a lateral view of the top of the container, rotated 90° in respect to the illustration in FIG. 1 and in accordance with claim 1.
Figure 4:
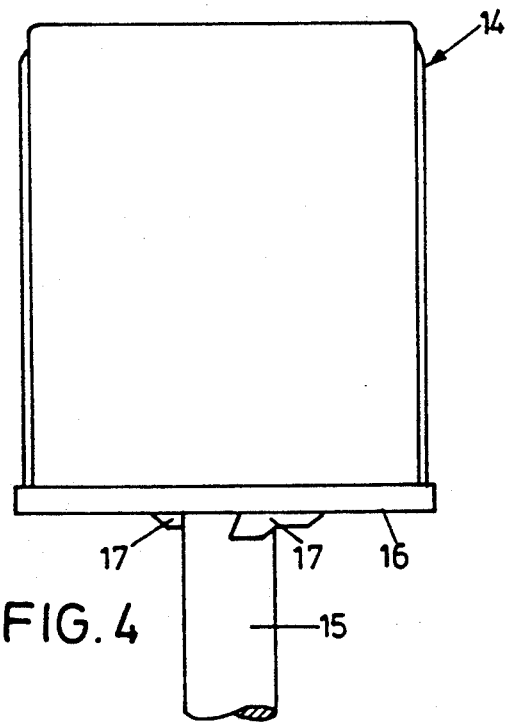
FIG. 4 is a lateral view of the screw closure cap associated with the container.
Figure 5:
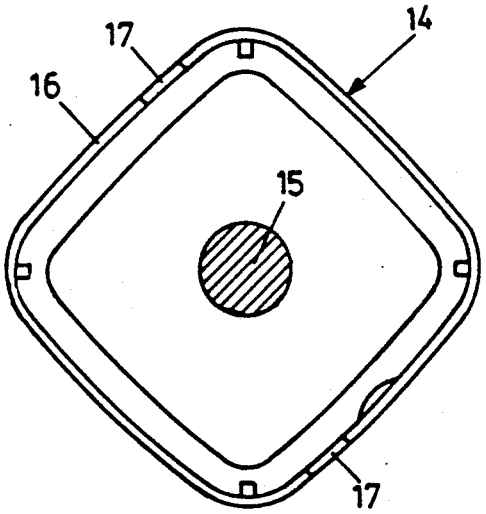
FIG. 5 is a bottom view of the screw closure cap shown in FIG. 4, FIGS. 6 and 7 are schematic views of the container shoulder and the underside of the closure cap during the closing procedure and in the closed position.
Figure 8:
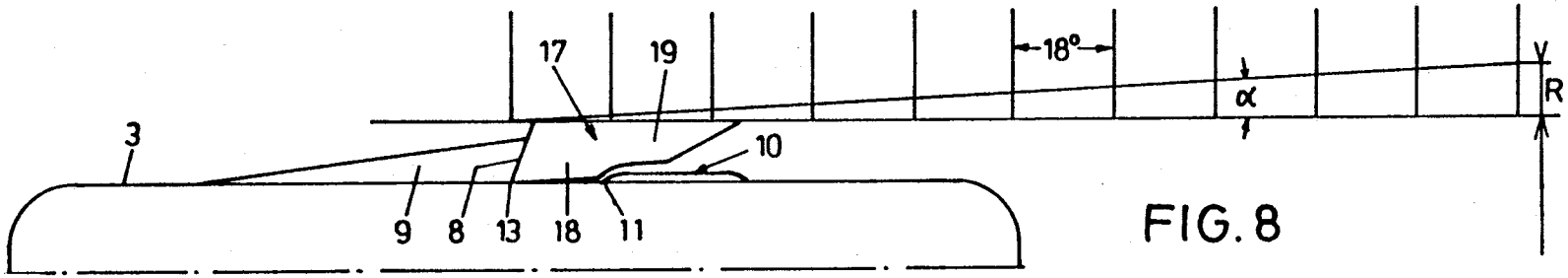
FIG. 8 is a view corresponding to FIGS. 6 and 7 illustrating the thread and rotational angle relationship.

A screw closure cap 14 shown in FIGS. 4 and 5 has a square, rounded-off outer contour corresponding to the base element 2 of the container 1. An applicator element 15, for example a mascara brush, has been indicated as being disposed in the interior of the screw closure cap 14. Two stop and catch protrusions 17, offset from each other by 180 , are provided on the lower edge 16 of the screw closure cap 14. Each stop and catch protrusion consists of a first section 18 and a second, receding section 19, as shown in FIG. 8.

According to the invention, the thread start 6 and the thread pitch $\alpha$ on the threaded neck 4 are selected in such a way and the distance A (see FIGS. 6 and 7) from the base 13 of the stop shoulder 8 to the end 12 of the return stop 10 which faces away is of such a size that in the course of closing in the direction of the arrow 22 (FIG. 6) the stop shoulder 20 moves along the thread path 23 towards the container shoulder 3. In this way, it contacts the top 24 of the return stop 10 about midpoint between its ends 11 and 12 (see FIG. 6) and then, as shown by dash-dotted lines in FIG. 6, continues to be moved, without being lifted again, essentially downwards in the direction towards the base 13 of the stop shoulder 8 while undergoing minimum elastic deformation.

Figure 7:
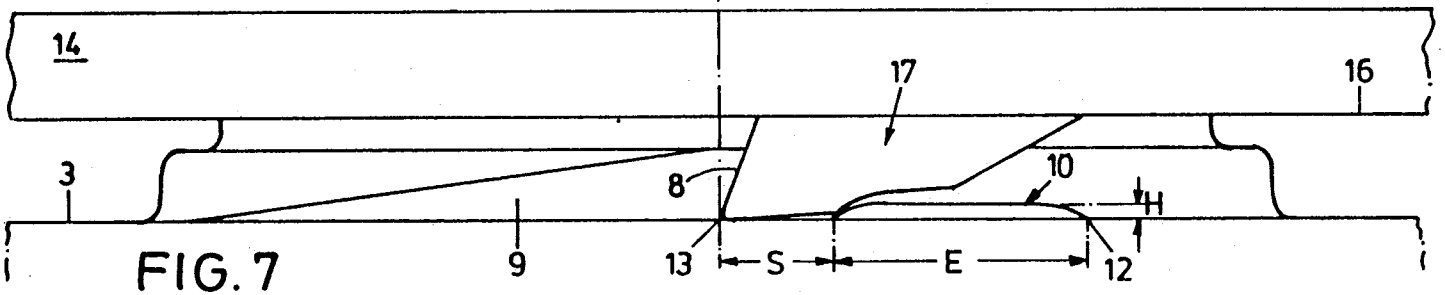

In the closed position shown in FIG. 7, the stop shoulder 20 of the stop and catch projection 17 rests against the stop shoulder 8 of the stop element 9, both stop shoulders 8 and 20 being inclined at an angle $\beta$ with respect to the longitudinal axis 25 of the container 2, while forming an undercut at the stop element 9. The first section 18 of the stop and catch projection 17 is located in the area between the base 13 of the stop element 9 and the front end of the return stop 10, while the second section 19 of the stop and catch projection 17 extends across the return stop 10 (see FIG. 7).

The above described overriding action of the stop and catch projection 17 on the return stop 10 is achieved with the dimensions provided, namely $A > H/\tan(\alpha + \Delta)$.

By means of the above described construction it becomes possible to reduce wear and allow the screw closure cap 14 to take the defined position in relation to the base element 2 of the container 1 in the closed end position. The obliquely extending stop shoulders 8, 20 also assure an axial fastening component. FIG. 8 is an illustration of the catch conditions in the closed end position, essentially corresponding to FIG. 7. However, for purposes of a better description of the rotational angle conditions, a rotational angle catch corresponding respectively to an angle area of 18° has been drawn in. Furthermore, the thread height R, corresponding to one-half of the thread pitch with a thread rotation movement of 180°, is illustrated. It follows from this illustration that the distance between the base 13 of the stop shoulder 8 and the front end 11 of the return stop 10 is approximately 18°.

The tool used for the manufacture of the present container has a denticulation in the back portion of the thread cores, such that the start of the thread on a single piece thread core achieves a defined association of the thread start 6 with the container 1, or of the stop shoulders 8 on the container 1 and the start of the thread of the screw closure cap 14 or of the stop shoulders 20 of the screw closure cap 14. The position of the thread cores can be changed by means of the denticulation and, accordingly, the start of the thread in the threaded part can be displaced in phase each time by, for example, 18° in accordance with the denticulation. This means that the stop shoulder 20 rides up with its base 21 on the return stop 10 either sooner or later by the amount of this phase shift. This assures that the intended overriding will be achieved in the center of the return stop 10.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A container for cosmetics, in particular a mascara unit, comprising a base element of plastic with a front shoulder extending approximately parallel to the container bottom and a threaded neck axially extending away from it, on which a screw closure cap can be threaded wherein, for the purpose of obtaining a defined final catch position of the screw closure cap, at least one stop shoulder and one return stop in the shape of a catch projection, disposed at a distance from the stop shoulder and extending over an extent E of the angle of circumference along the front shoulder, is provided in the bottom area of the threaded neck at the front shoulder, wherein a catch recess, for a catch and stop projection, said catch and stop projection having a shape and dimension at a lower end corresponding to said catch recess and in the locked state is engaged between the stop shoulder and the return stop and protrudes beyond the lower edge of the screw closure cap (14), is provided between this stop shoulder and the return stop, and wherein the thread pitch and the start of the thread of the threaded neck and the screw closure cap relative to each other are of such dimensions and are placed such that the catch and stop projection of the screw closure cap in its final catch position comes to rest with its lower end at a base of the stop shoulder of the container shoulder, wherein the top (24) of the return stop (10) is plane and oriented transversely in relation to longitudinal axis (25) of the container and the extent E of the angle at circumference of the return stop (10) in relation to the position of the start of the thread (6) to the thread pitch ($\alpha$) on the one hand, and to the position of the stop shoulder (8) at the container shoulder (3) on the other hand are chosen in such a way that in the course of closing the catch and stop projection of the screw closure cap (14) contacts the top (24) of the return stop (10) and from there arrives in said final catch position in the course of essentially steady downward movement.

2. A container in accordance with claim 1, wherein the return stop (10) is placed and is of such a size that $A > H/\tan \alpha$, where A is the distance between the base (13) of the stop shoulder (8) and the end of the return stop (10) which is facing away from the stop shoulder (8), H is the height of the return stop (10), measured starting at the container shoulder (3), and $\alpha$ is the thread pitch.

3. A container in accordance with claim 2, wherein the return stop (10) is placed and is of such a size that $A > H/\tan (\alpha + \Delta)$, where $\Delta$ is the thread tolerance.

4. A container in accordance with claim 1, wherein the stop shoulder (8) at the container shoulder (3) is obliquely inclined with respect to the longitudinal axis of the container while forming an undercut.

5. A container in accordance with claim 4, wherein a stop shoulder (20) of the catch and stop projection (17) of the screw closure cap (14) is obliquely inclined with respect to the longitudinal axis and corresponds to an inclined side on the stop shoulder (8) on the container shoulder (3) in such a way that the stop shoulder (8) lies flat against the stop shoulder (20) in said final catch position of the screw closure cap (14).

6. A container in accordance with claim 1, wherein the catch and stop projection (17) on the screw closure cap (14) has, looking in the peripheral direction, two sections offset in respect to each, where in said final catch position one of the sections rests on the container shoulder (3) in the catch recess between the stop shoulder (8) and the return stop (10) and the second section lies over the return stop (10).

7. A container in accordance with claim 1, wherein the container (1) is made of a relatively soft plastic.

* * * * *